United States Patent [19]

Kingsford

[11] 4,261,376

[45] Apr. 14, 1981

[54] ADJUSTABLE COSMETIC WIPER

[75] Inventor: Ted I. Kingsford, Memphis, Tenn.

[73] Assignee: Plough, Incorporated, Memphis, Tenn.

[21] Appl. No.: 96,709

[22] Filed: Nov. 21, 1979

Related U.S. Application Data

[63] Continuation-in-part of Ser. No. 857,074, Dec. 5, 1977, Pat. No. 4,194,848.

[30] Foreign Application Priority Data

Nov. 30, 1978 [EP] Eup. Pat. Office ..... 78200323

[51] Int. Cl.[3] ..... A45D 40/30

[52] U.S. Cl. ..... 132/88.5; 401/122; 138/45; 401/128; 132/88.7

[58] Field of Search ..... 132/88.5, 88.7; 401/122, 5, 128, 129, 207; 138/45

[56] References Cited

U.S. PATENT DOCUMENTS

| | | | |
|---|---|---|---|
| 3,998,235 | 12/1976 | Kingsford | 132/88.5 |
| 4,194,848 | 3/1980 | Kingsford | 401/122 |

*Primary Examiner*—G. E. McNeill

*Attorney, Agent, or Firm*—Vincent H. Gifford; Bruce M. Eisen

[57] ABSTRACT

A wiper for a cosmetic applicator in which the size of the wiper orifice is adjustable.

16 Claims, 12 Drawing Figures

ADJUSTABLE COSMETIC WIPER

This is a continuation-in-part of application Ser. No. 857,074, filed Dec. 5, 1977 now U.S. Pat. No. 4,194,848.

This invention relates to an improved device for applying a predetermined metered amount of a cosmetic. More particularly, the device relates to a wiper for a non-rigid mascara applicator, e.g. a brush, in which the quantity of mascara which is retained by the applicator is predetermined by manually adjusting the size of the wiper orifice. This enables a user to reproduce a previous result and to vary the amount of mascara retained by the applicator.

In most mascara products, the applicator is disposed in a mascara mass within the cosmetic container. The excess mascara is removed by an elastic or rigid wiper as the applicator is withdrawn from the container. A set amount of cosmetic remains within or on the applicator for application to the eyelashes. In any given application, essentially the same quantity of mascara is retained regardless of the length, thickness or density of the users' lashes, and without regard as to whether the upper or lower lashes are to be treated.

In accordance with the present invention, it will now be possible for the mascara user to retain on the applicator the quantity of mascara suited for her lashes, particularly her upper lashes. A user can therefore apply, at her discretion, either a heavy or thin coating of mascara by merely selecting the volume of mascara which is to be retained on the applicator. The mascara volume is determined by selecting an appropriate diameter or cross-sectional area for the wiper orifice. A user with skimpy, sparsely distributed lashes or one who prefers maximum separation between the lashes will no longer be burdened with the mess associated with an excessive quantity of mascara. A user having a preference for a full or heavy application will now be able to uniformly coat her lashes more rapidly without the need for constant recoating of the applicator. It will also be possible for the user to select the quantity of mascara suited to her lower lashes which are invariably shorter and less dense than the upper lashes. A user can also control the degree to which the individual lashes stick together. For example, for evening use some women prefer the "cluster" or "starry" look which results when the individual lashes stick together in discrete clusters.

Accordingly, it is an object of the present invention to provide a mascara applicator which will enable the user to select the amount of mascara which is to be applied.

It is a further object to provide a mascara applicator which will hold the amount of mascara suited for both the upper and lower lashes of any individual user.

It is a further object to provide a cosmetic applicator which allows a user to reproduce a previous result.

It is a further object to provide a brush-type applicator which will hold a proper amount of a pasty, liquid, semiliquid or powder product in which a predetermined metered amount of the product is to be dispensed.

Figure 1:
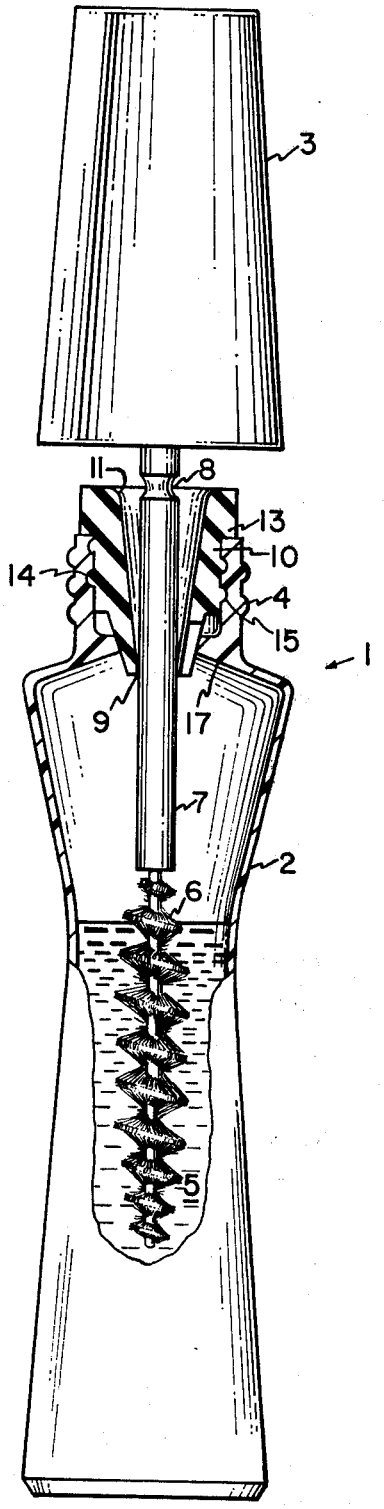
FIG. 1 is a longitudinal sectional view of an adjustable wiper within a fully assembled mascara container.

Referring to FIG. 1, there is illustrated an eyelash cosmetic package 1 that consists of a container or tubular reservoir 2 and a cap 3. The cap 3 is provided with internal threads (not visible) which mesh with the external threads 4 of container 2. The container is shown partly filled with a cosmetic composition 5.

A non-rigid mascara applicator 6, e.g., a brush, is attached to the cap 3 by a shaft or rod 7 with the cap serving as a handle for the applicator. The shaft 7 has a reduced portion 8 which is adjacent to the wiper orifice 9 when the closure is fully tightened onto the container. This minimizes any deforming stress on the wiper when it is not in use.

The wiper 10 comprises a tubular frame which is positioned within the neck of the container. The interior wall 11 of the wiper is tapered toward the bottom of the container. The wiper has an integral dial ring 13 at one end and a wiper orifice 9 at the other end. The wiper has a guide means 14 which mates with a corresponding guide means 15 in the wall of the container neck. In FIG. 1 the guide means is shown as a screw thread. The wiper contains at least one longitudinal slit 16. The bottom of the frame is within the opening formed by container ledge 17. At least a portion of the wiper 10 would be located within the container 2, preferably within the neck of the container.

Rotation of the dial ring 13 moves the wiper longitudinally within the container, thereby changing the diameter of the wiper orifice 9 as it is compressed or expanded by the ledge 17. The longitudinal slit(s) 16 relieves the compression of the wiper mass and permits the wiper orifice to change in diameter while maintaining a generally circular configuration. The preferred embodiment would have at least four longitudinal slits which diverge toward the bottom of the container when it is assembled.

Figure 2:
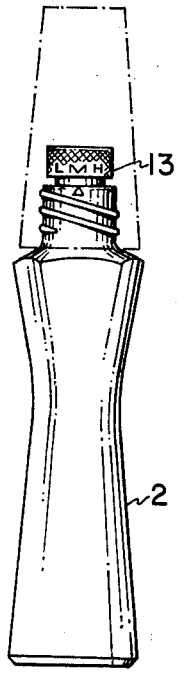
FIG. 2 is a longitudinal view of the mascara container of FIG. 1.

FIG. 2 shows a cosmetic container having three indicia for the diameter or cross-sectional area of the orifice. Each of the indicia correspond to a specific, preselected, reproducible orifice size. On the "L" (Low) setting the wiper orifice would have a minimum cross-sectional area so that only a small amount of cosmetic is retained by the applicator.On the "H" (High) setting the wiper orifice would have a maximum cross-sectional area, thereby leaving a large quantity of cosmetic. The "M" setting would be a medium position. Obviously any number of settings could be used. The settings provide a means to allow the user to reproduce a previous use.

Figure 3:
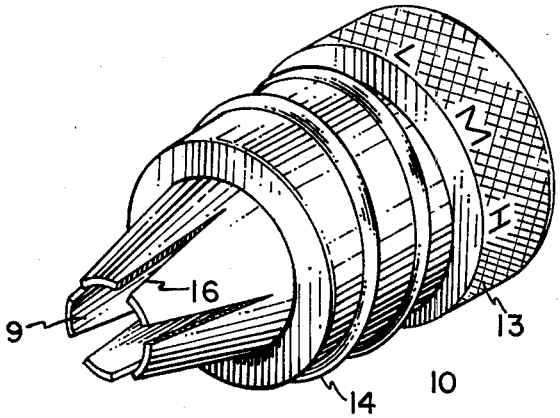
FIG. 3 is an enlarged perspective view of the wiper shown in FIG. 1.

FIG. 3 is a perspective view of the wiper shown in FIG. 1.

Figure 4:
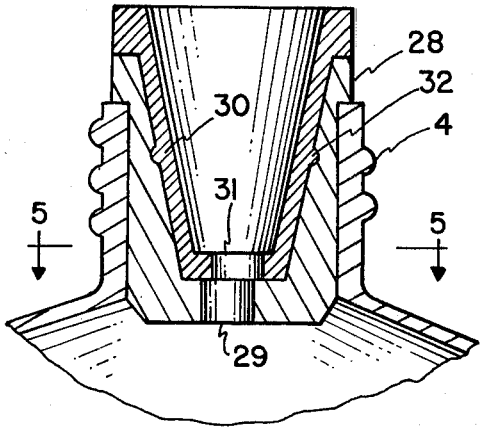
FIG. 4 is a cross-sectional view of another wiper variant within the container neck.
Figure 5:
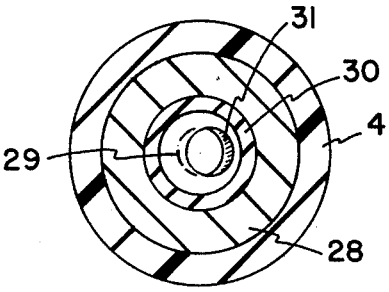
FIG. 5 is a top view along lines 5—5 of FIG. 4 showing the wiper orifice at its minimum size.
Figure 6:
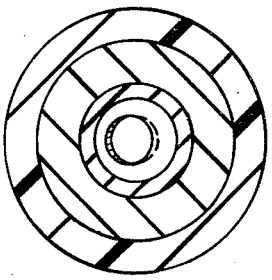
FIG. 6 is a top view similar to FIG. 5 but showing the orifice at its maximum size.

FIG. 4 is a side view of another wiper embodiment within the container neck. The wiper which is made from either an elastic or rigid material comprises a sleeve member 28 having a first opening 29 and a rotatable frame means 30 having a second opening 31 which is adjacent and off-center to the first opening. The two members are rotatably attached to one another through a tongue and groove means 32 which is perpendicular to the container axis. The overlapping portions of the two openings comprise the wiper orifice. Rotation of the frame varies the cross-sectional area of the wiper orifice between the minimum and maximum orifice sizes shown in FIGS. 5 and 6, respectively. If openings 29 and 31 are circular the overlap portion would be slightly elliptical. Preferably the openings should be shaped so that the wiping orifice is substantially circular.

Figure 7:
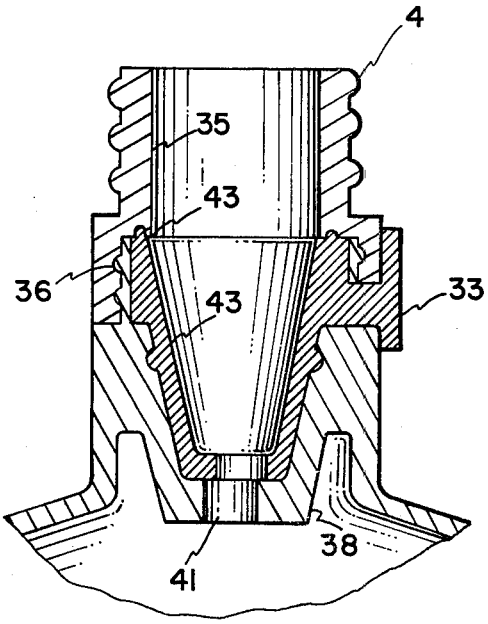
FIG. 7 is a cross-sectional view of another wiper variant.

FIG. 7 is a cross-sectional view of a modification similar to the one shown in FIG. 4. It allows adjustment of the diameter of the wiper orifice by an outside control means 33. The sleeve member 38 is shown as an inteqral part of the container neck. The control means 33 is preferably shaped as a finger grip. The upper part of the container neck carrying the external threads 4 (which are necessary to attach the cap to the container) is shown as a separate part 35 attached to the container by a screw thread 36 or similar means.

Figure 8:
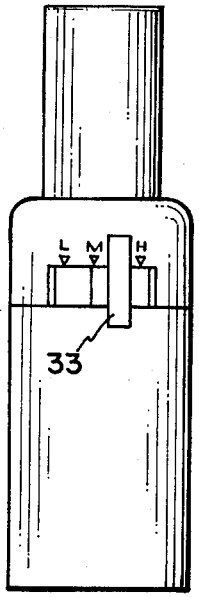
FIG. 8 is a longitudinal view of the mascara package of FIG. 7.

FIG. 8 shows a perspective view of a container using the FIG. 7 wiper embodiment.

Figure 9:
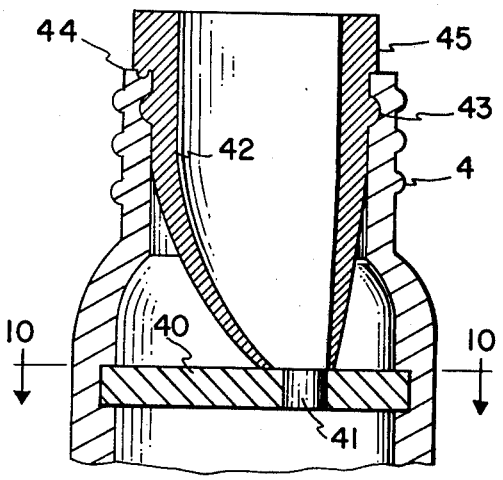
FIG. 9 is a cross-sectional view of another wiper variant.

FIG. 9 shows a side view of another wiper embodiment within the container neck. The wiper consists of an elastic or rigid disk 40 having several holes or apertures 41 with varying diameter and an eccentric lead-in sleeve member 42 which is rotatably attached to the container neck through a tongue and groove means 43. Holes 41 comprise the wiping orifice. The interior wall of member 42 is tapered toward the disk 40. The minimum cross-sectional area of the member 42 is at least equal to the cross-sectional area of the largest hole 41. Rotation of the dial ring 45 positions the member 42 adjacent a selected hole 41. It is held in position by a detent 44 which fits in a corresponding indent in the container wall. A series of indents corresponding to each hole are provided. The amount of cosmetic composition retained on the applicator is determined by adjusting the member 42 to correspond to a selected hole 41.

Figure 10:
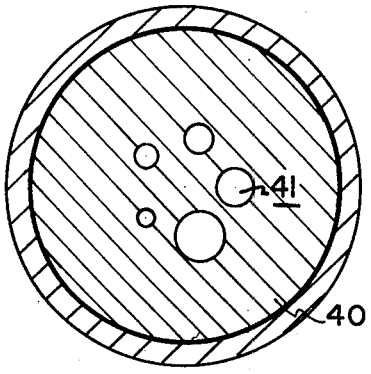
FIG. 10 is a top view along lines 10—10 of FIG. 9.

FIG. 10 shows a wiper embodiment in which the applicator must be removed from the container before the wiping orifice can be adjusted.

Figure 11:
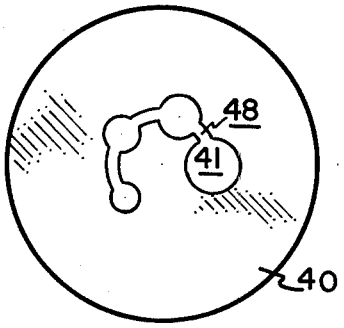
FIG. 11 is variation of the FIG. 10 embodiment.

FIG. 11 shows an embodiment similar to FIG. 10 except that passages 48 are provided between each of the holes 41. In this embodiment the applicator can remain in the bottle while the wiper is adjusted.

Figure 12:
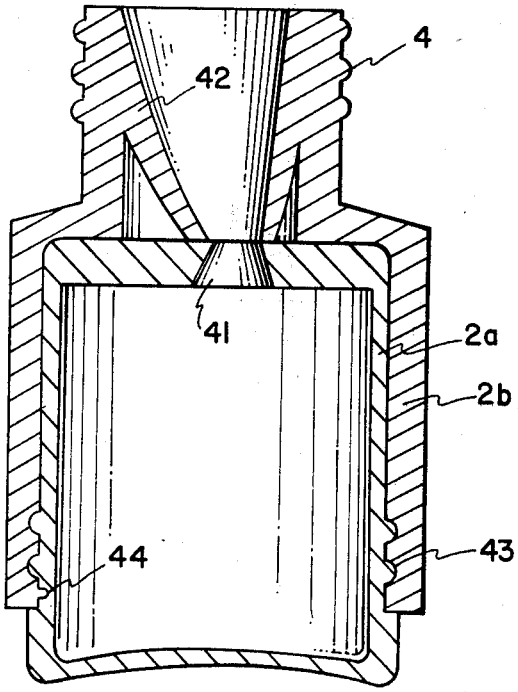
FIG. 12 is a cross-sectional view of another embodiment.

FIG. 12 shows an embodiment similar to FIG. 9 except that the wiper adjustment is accomplished by rotation of the reservoir 2*a* relative to cover 2*b*. In this embodiment, the indicia could be located on either the reservoir or the cover.

The non-rigid applicator head is preferably a radial bristle brush such as shown in U.S. Pats. Nos. 3,214,782 and 3,870,186. Other non-rigid applicators such as the longitudinal bristle brush shown in U.S. Pat. No. 3,883,254; the foam tipped applicator as shown in U.S. Pat. No. 3,908,675; or the variable applicator shown in U.S. Pat. No. 3,998, 235 would also be suitable. The wiper is preferably made of an elastomeric or a thermoformed plastic material having a slight resiliency, although the FIG. 9–12 wipers could be made of a harder material, e.g., polypropylene, having little or no resiliency.

The preferred mascara package is a mascara product in which the applicator is an elongated radial bristle brush having a tapered head, an overall diameter of 3–10 mm and an overall length of 5–35 mm. The wiper orifice has an aperture corresponding to a cross-sectional area which can be varied between 6 and 15 $mm^2$. In the case of a plurality of a substantially circular orifices, the orifice diameter would generally be varied between 2.5 and 4.5 mm, preferably at about 0.3–0.7 mm intervals. The mascara composition could be either solvent or water based.

The wiper disclosed herein can be used in a variety of applications other than for mascara. For example, it could be used to control the amount of material used in coloring an eyebrow, moustache, beard or hair upon the head, or to meter the amount of any pasty, liquid, semi-liquid or powder product which is a cosmetic, medicament or otherwise.

While several embodiments have been shown to illustrate the invention, it will be understood by those skilled in the art that various changes and modifications can be made without departing from the scope of the invention.

I claim:

1. A package comprising:

a. a container having fluent material therein;

b. a container closure;

c. a wiper having an orifice means adapted to wipe excess material from the applicator; said orifice means comprising a plurality of apertures of differing cross-sectional area;

d. an applicator attached to said closure by a shaft and adapted to be passed through one of said wiper orifice apertures and immersed in said fluent material when said closure is attached to said container;

e. a calibrated adjusting means to permit selection of the chosen orifice aperture, said adjusting means permitting a user to reproduce a previous result.

2. A package as in claim 1 wherein said fluent material is a cosmetic composition.

3. A package as in claim 1 wherein said wiper comprises a plate positioned across said container and substantially perpendicular to the longitudinal axis of said container and a tubular lead in member, said adjusting means comprising a means to align one end of said tubular member with each of said aperatures.

4. A package as in claim 3 wherein said tubular member is rotatable with respect to the neck of said container.

5. A package as in claim 3 wherein said tubular member is integral with the neck of said container.

6. A package as in claim 1 wherein said calibrated adjusting means further comprises:

a. an indicating means comprising a plurality of indicia, each indicia corresponding to a different orifice cross-sectional area, and b. a means to position said indicia to correspond to the selected orifice cross-sectional area.

7. A package as in claim 6 wherein said container comprises a reservoir and a cover overlapping said reservoir wherein said indicating means is located on said reservoir.

8. A package as in claim 1 wherein said applicator is a radial bristle brush.

9. A cosmetic package as is in claim 8 wherein said brush has an overall diameter of 3–10 mm and an overall length of 5–35 mm.

10. A cosmetic package as in claim 1 wherein said fluent material is a cosmetic composition and said adjusting means is adapted to adjust the cross-sectional area of the orifice between 6 and 15 $mm^2$.

11. A cosmetic package as in claim 10 wherein said applicator is made of a compressible foam material.

12. A cosmetic package as in claim 10 wherein each of said apertures are substantially circular.

13. A cosmetic package as in claim 10 wherein said cosmetic composition is a pasty, liquid or semi-liquid material.

14. A cosmetic package as in claim 10 wherein said cosmetic composition is a powder.

15. A cosmetic package as is claim 10 wherein said wiper is made of a rigid material.

16. A cosmetic package as is claim 10 wherein said wiper is made of an elastic material.

* * * * *